United States Patent [19]

Irvine

[11] Patent Number: 4,741,433

[45] Date of Patent: May 3, 1988

[54] CHILD RESISTANT BOX

[75] Inventor: J. David Irvine, Scarborough, Canada

[73] Assignee: IDMD Inc., Scarborough, Canada

[21] Appl. No.: 24,319

[22] Filed: Mar. 10, 1987

[51] Int. Cl.[4] ..... B65D 43/18

[52] U.S. Cl. ..... 206/1.5; 220/324; 220/331

[58] Field of Search ..... 206/1.5, 262, 270; 220/331, 329, DIG. 25

[56] References Cited

FOREIGN PATENT DOCUMENTS 230704 2/1911 Fed. Rep. of Germany ..... 206/1.5

*Primary Examiner*—William Price

*Attorney, Agent, or Firm*—Murray Schaffer

[57] ABSTRACT

The invention relates to child resistant boxes of the type where a storage container slides in a closure sleeve. Such a box, according to the invention, may have sliding movement in two different dimensions to open or close the box. Opening movement in one of the dimensions may partially open the box and opening movement in the second dimension may fully open it. Closing is by reversing the movements. A latch is provided to keep the box closed. It is movable into a release position in which it does releases the container so that the box may be opened. The initial opening movement may suitably be rectilinear movement and the second movement may be rotary. The movement may be controlled by means of a cam slot on one of the housing or container engaging a lug on the other.

9 Claims, 2 Drawing Sheets

CHILD RESISTANT BOX

This invention relates to a child resistant storage box.

Various child resistant bottles, jars and cans have been produced. These often have screw tops including a variety of tamper-resistant mechanisms. Such storage vessels are satisfactory for many purposes but for some purposes, e.g. where pills are to be administered in some particular order, packages with discreet locations for each pill, are to be preferred. Packages of this type may comprise a container to contain the pills or other small articles which slides in a sleeve between open and closed position. Such boxes are often made of card, waxed card or light plastic. Often they are held in the closed position by friction alone.

A need has been felt for a storage box comprising a container slidable in a closing sleeve which is latchable and easily releasable while providing some protection from accidental opening, and to provide secure, child-proof storage for pharmaceutical pills and the like.

According to the invention is provided a child resistant storage box, suitable for storing small articles, comprising a container being at least partially open at the top and having a base with upstanding side walls; a housing for the container having a top adapted to close the container connected to a bottom on which the container is located, the container being movable in the housing in a first dimension between a closed position and a partially open position and in a second dimension between the partially open position and an open position; and a latch on the housing actuable to engage the container in closed position and to release it.

Suitably movement of the container in the first dimension is rectilinear movement in a plane parallel to the housing top and bottom and movement of the container in the second dimension is rotary movement in the same plane.

A cam may be included on one of the container base and the housing bottom cooperating with a lug on the other of the container base and housing bottom to define movement in each of the first and second dimensions. The cam may comprise a slot. The lug may be engaged in the slot and disengagement means may be located at a point along the slot to permit assembly and disassembly of the container and the housing. The cam and lug also co-operate to hold the container in closed position within the sleeve.

Alternatively or in addition to the cam and lug mechanism, the box may include a pin on the top and/or bottom of the housing engaging slidably in a channel parallel to and adjacent a container side wall, the length of the channel corresponding to the desired distance of rectilinear travel, and the pin or pins being pivotable in the slot to provide for rotary movement of the container. The pins also lend security to the container and assist in maintaining the container in closed, locked position.

The latch may comprise a detent normally engaging an inner surface of the container when the box is closed, the detent having a shaft extending to the exterior of the housing and being manually rotatable into a release position in which it is aligned with an aperture in the container, the aperture being of a size and shape to permit the passage of the detent.

The housing top and/or bottom may be resiliently deformable whereby the container and the housing are assemblable and disassemblable. In this case a guide may be provided for the pin(s) and/or lug to locate them correctly with respect to the channel and the cam respectively.

An embodiment of the invention will now be described by way of example with reference to the drawings, in which.

Figure 1:
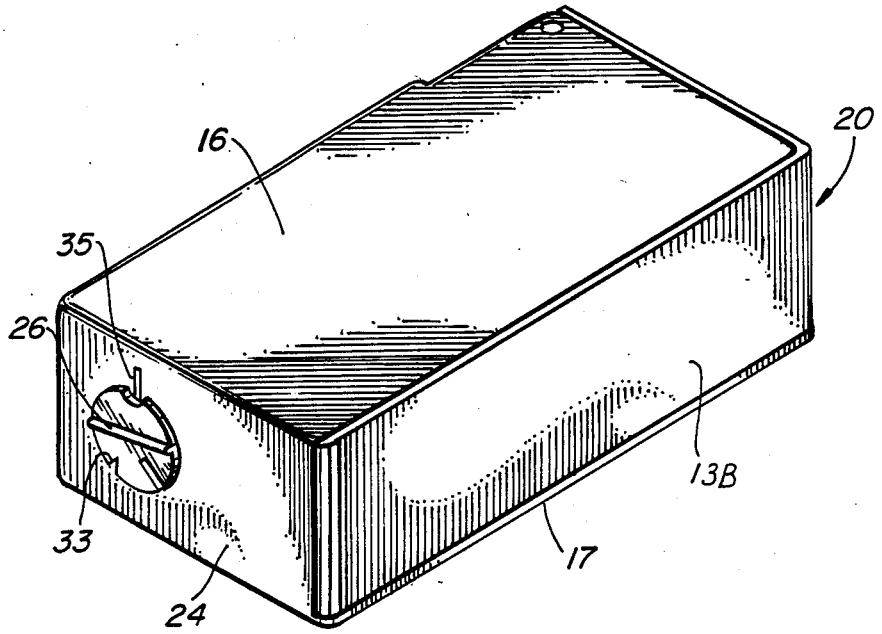
FIG. 1 shows a storage box according to the invention in closed position.
Figure 2:
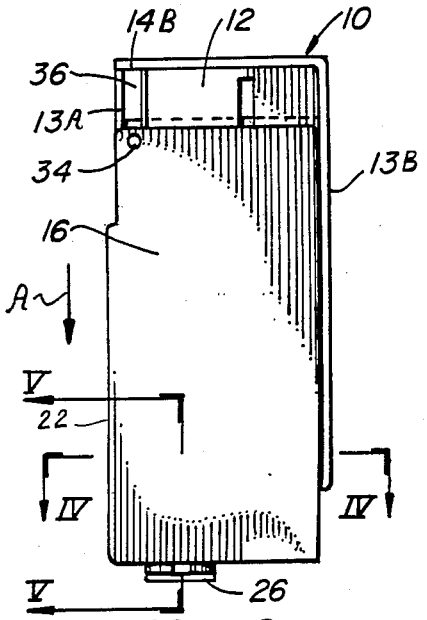
FIG. 2 shows the storage box of FIG. 1 in a partially open position.

The storage box shown in the drawings may be of such a size to be suitable for the storage of pills, e.g. medicine pills. Alternatively it may be suitably sized for storing jewelry, small hardware items such as washers, screws, nuts, etc., or as spices.

The box illustrated comprises a container 10 having a base 12, side walls 13A and 13B and end walls 14A and 14B. The rectangular shape shown will usually be found convenient but other shapes are possible within the confines of the mechanism. The container, when the box is closed, is slidable between the top 16 and the bottom 17 so as to form, as generally seen in FIG. 1*a* of a housing 20. The housing 20 is peripherally enclosed a side wall 22 and an end wall 24 extending from the base 17 and an opposing sidewall 13A and end wall 14A extending from the container.

The box may be held closed by a latch comprising a shank 28 extending rotatably through the end wall 24 of the housing and through a keyhole 32 in the corresponding end wall 14 of the container. The shank 28 may be manually rotated by means of a boss 26 adjacent the outer face of housing end wall 24 to move a detent 30 adjacent the inner face of container end wall 14A, which detent corresponds in outline shape with that of the keyhole, into and out of alignment with the keyhole 32. In most positions the detent 30 is not aligned with the keyhole 32 and, when the box is closed, holds the container firmly in the closed position. However, when the detent is aligned with the keyhole, the container is released. A mark 33 may be provided on the boss which when adjacent a mark 35 on the housing end wall 24 indicates that the latch is in a release position. Other marks may also be provided on the boss to confuse the person unfamiliar with the mechanism and thereby increase tamper resistancy.

Figure 3:
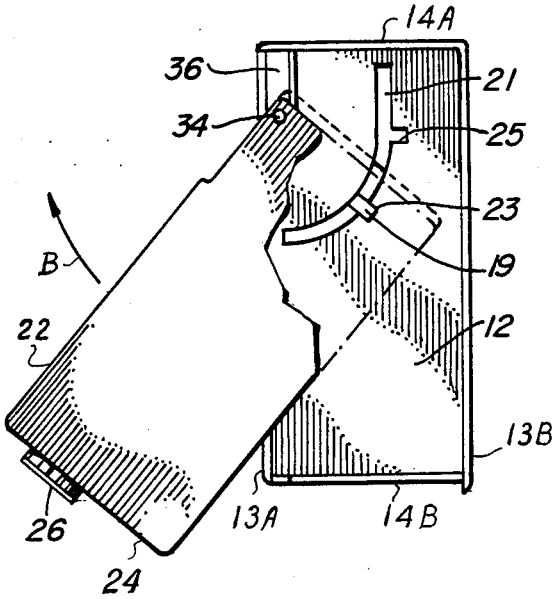
FIG. 3 shows the storage box of FIG. 1 between the partially open position and an open position.
Figure 4:
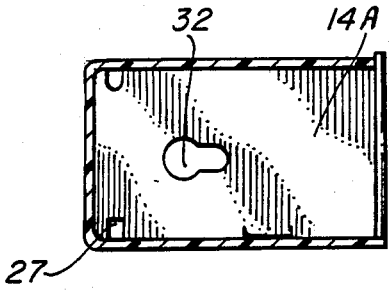
FIG. 4 is a section on the line IV—IV of FIG. 2.
Figure 5:
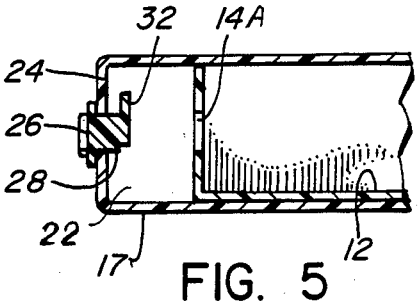
FIG. 5 is a section on the line V—V of FIG. 2.
Figure 6:
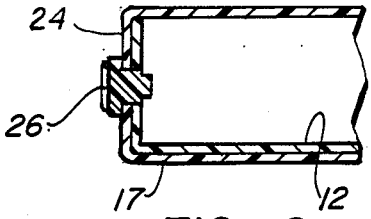
FIG. 6 is a section similar to that of FIG. 5 but with the box closed.

The container and housing are relatively movable in a first rectilinear direction illustrated by the arrow A, to partially open the box and from this position are relatively rotatable or swingable in the lateral direction shown by the arrow B. In the first instance, the walls 22 and 24 of the housing slidable abutt the walls 13B and cover the walls 14B respectively while in the second position, they swing clear from them (FIG. 3).

For the purpose of guiding both rectilinear and rotary movement of the container a cam may be provided. Suitably a cam slot 21 is provided in housing bottom 17 or in the container bottom 12 to cooperate with a lug 19 on the other of the bottoms. The lug 19 may project through the slot and be provided with a head 23 which overlaps an edge of the slot to inhibit disengagement of the lug 19 from the slot 17. As illustrated the slot 21 is provided in container bottom 12 and the lug 19 is provided on housing bottom 17.

For making the cam guided movements more precise or as an alternative guide means, a channel 36 may be provided adjacent the adjacent container side wall. Corner pins 34 fixed on the inner surfaces of the housing top 16 and bottom 17 slide in channel 36 during rectilinear movement until the end of the channel which constitutes a stop to limit the extent of rectilinear travel. The container may be rotated outwardly from the housing by means of pins 34 pivoting in slot 36, with direction of movement being shown by the arrow in FIG. 3. The whole of the open top of container 10 may be exposed by this secondary, rotary motion.

Suitably, the length of rectilinear travel is just sufficient to withdraw the container from the housing into a partially open position in which pills or other articles can be dispensed individually through the partially uncovered top of the container. However, it may be desired to make this length such that no articles can be released as a result of this preliminary opening movement, thereby providing some additional security against opening by accident or tampering.

In closing the box, the container is rotated back into the housing into partially open position. The detent 30 is aligned with the keyhole 32 and the container may be slid rectilinearly to its closed position. The boss 26 is rotated to move the detent out of alignment with the keyhole to engage the container end wall 14A and hold the box closed.

A box according to the invention may be easy to assemble or disassemble into its separate components. If at least the top and bottom of the housing 20 are made of resiliently deformable material they may be forced apart, located in position and allowed to spring back into shape to snap pins 34 into channel 36. When a cam slot 21 is provided with a lug 19 having a head 23, a widened part 25 of the slot 21 may be provided to permit access of the head 23.

Conveniently, a guide is provided to locate pins 34 and head 23 in proper position to snap into channel 36 and widened part 25 of slot 21 respectively. The guide may be a groove 27 in the under surface of container 10. Groove 27 may be aligned with and be an extension of channel 36. When the top and bottom of the housing are forced apart they may the be allowed to spring back without prelocation of the pins 34 and lug head 23. The container may be moved within the housing, the top and bottom of which are still under some force biassing them apart due to the fact that pins 34 and lug 19 are not properly located. When the movement results in one of the pins 34 being located in groove 27, further movement will be guided by the groove to properly locate pins 34 and lug 19 whereupon the top and bottom of the house snap into position. Groove 27 may extend over the whole length of container 10 to terminate in a deepened notch at end wall 14 containing keyhole 32. Pin 34 may be initially located in the notch. A corresponding notch may be provided for lug 19 and leading, if desired, to a guide groove for lug 19.

The embodiments of the invention in which an exclusive property or privilege is claimed are defined as follows:

1. A child resistant storage box, suitable for storing small articles, comprising a container being at least partially open at the top and having a base with understanding side walls; a housing for the container having a top adapted to close the container connected to a bottom said container being slidably located between the top and bottom of said housing, said container and housing having means for slidably interconnection permitting the container to be movable in the housing in a first dimension between a closed position and a partially open position and in a second dimension between the partially open position and an open position; and including cooperating latch means actuable to selectively engage the container and housing in closed position against slideable movement, movement of the container in the first dimension being rectilinear in a plane parallel to the housing top and bottom and movement of the container in the second dimension being rotary movement in the same plane.

2. A box as claimed in claim 1, which includes a cam on one of the container base and the housing bottom cooperating with a lug on the other of the container base and housing bottom to define movement in each of the first and second dimensions.

3. A box as claimed in claim 1, in which the cam comprises a slot.

4. A box as claimed in claim 3, in which the lug is engaged in the slot and disengagement means are located at a point along the slot to permit assembly and disassembly of the container and the housing.

5. A box as claimed in claim 1, which includes a pin on the top and/or bottom of the housing engaging slidably in a channel parallel to and adjacent a container side wall, the length of the channel corresponding to the desired distance of rectilinear travel, and the pin or pins being pivotable in the slot to provide for rotary movement of the container.

6. A box as claimed in claim 1, which includes a cam on one of the container base and the housing bottom cooperating with a lug on the other of the container base and housing bottom to define movement in each of the first and second dimensions and which also includes a pin on the top and/or bottom of the housing engaging slidably in a channel parallel to and adjacent a container side wall, the length of the channel corresponding to the desired distance of rectilinear travel, and the pin or pins being pivotable in the slot to provide for rotary movement of the container.

7. A box as claimed in claim 2, in which the latch comprises a detent normally engaging an inner surface of the container when the box is closed, the detent having a shaft extending to the exterior of the housing and being manually rotatable into a release position in which it is aligned with an aperture in the container, the aperture being of a size and shape to permit the passage of the detent.

8. A box as claimed in claim 6, in which at least the housing top and/or bottom is resiliently deformable whereby the container and the housing are assemblable and disassemblable.

9. A box as claimed in claim 6, in which a guide is provided for the pin(s) and/or lug to locate them correctly with respect to the channel and the cam respectively.

* * * * *